US007036606B2

(12) United States Patent
Rossi

(10) Patent No.: US 7,036,606 B2
(45) Date of Patent: May 2, 2006

(54) QUICK-DETACH VEHICLE-MOUNTED AUGER DRIVER

(76) Inventor: Frank W. Rossi, General Delivery W. Highway 90, Alpine, TX (US) 79830

( * ) Notice: Subject to any disclaimer, the term of this patent is extended or adjusted under 35 U.S.C. 154(b) by 114 days.

(21) Appl. No.: 10/713,664

(22) Filed: Nov. 17, 2003

(65) Prior Publication Data

US 2005/0103529 A1 May 19, 2005

(51) Int. Cl.
*E21B 7/02* (2006.01)

(52) U.S. Cl. ..... 173/28; 173/184; 175/170; 172/25

(58) Field of Classification Search ..... 173/184, 173/28, 185; 175/170; 37/466; 172/22, 172/25

See application file for complete search history.

(56) References Cited

U.S. PATENT DOCUMENTS 420,004 A * 1/1890 Bowers et al. ..... 173/85
3,815,689 A * 6/1974 Kuhl ..... 173/27
4,124,081 A 11/1978 Deike ..... 173/28
4,869,002 A 9/1989 Glenn ..... 37/117.5
4,961,471 A 10/1990 Ovens ..... 175/170
5,746,277 A 5/1998 Howell, Jr. ..... 173/184
6,155,359 A 12/2000 Gardner ..... 175/170
6,237,429 B1 * 5/2001 Melnyk ..... 73/864.45
6,325,588 B1 * 12/2001 Nolin ..... 414/526
2002/0014352 A1 * 2/2002 Rust et al. ..... 175/19
2004/0031617 A1 * 2/2004 Skarlupka et al. ..... 173/184

* cited by examiner

*Primary Examiner*—David Bagnell
*Assistant Examiner*—Daniel P Stephenson
(74) *Attorney, Agent, or Firm*—Christopher J. Whewell

(57) ABSTRACT

The present invention provides a device useful for boring holes into the earth, and is especially useful for drilling holes in which fence posts are to be placed. A device according to the invention is completely self-powered, having its own on-board engine which supplies all of the power necessary for the boring operation and other movements of the device associated therewith. A device according to the invention is readily removable from and attachable to a motorized vehicle equipped with a trailer hitch, and is adapted to configure itself in a retracted position for ease in storage and transportation.

13 Claims, 4 Drawing Sheets

QUICK-DETACH VEHICLE-MOUNTED AUGER DRIVER

TECHNICAL FIELD

The present invention relates generally to vehicle-mounted auger drivers, including post hole diggers. More particularly, the invention pertains to a vehicle-mounted post hole digger which may be readily removed and re-fitted to a motorized vehicle or other piece of equipment.

BACKGROUND

The use of vehicle-mounted post hole diggers is known in the prior art. More particularly, vehicle-mounted post hole diggers previously devised and utilized are known to consist basically of many seemingly-basic structural configurations, including a plurality of designs presenting the prior art which have been developed for the fulfillment of various objects and requirements dictated by the circumstances faced by the inventors. For example, U.S. Pat. No. 4,124,081 teaches a mobile hydraulic driving machine which comprises: a) a wheeled vehicle having a frame; b) a pedestal mounted on and supported by the frame, having an upright mast; c) a sleeve rotatable on the mast; d) a lower derrick boom pivoted on the upper end of the sleeve; e) an upper derrick boom telescoped in the lower boom; f) a driving tool removably mounted on the end of the upper boom beyond the end of the lower boom; g) a means for rotating the sleeve to position the derrick boom circumferentially of the vehicle; and h) a means for extending and retracting the upper boom to space the driving tool relative to the vehicle. The driving tool has: i) an adjacent upright post with a foot adapted to rest on the ground; ii) a means for controlling the attitude of the post relative to the upper derrick boom; iii) a carriage slidable on the post; iv) a hammer guide mounted on the carriage; v) a spring-loaded anvil depending from the hammer guide; vi) a hammer slidable in the hammer guide adapted to impact against the anvil; vii) a hydraulic lift mechanism for the hammer; viii) tension springs stretched by the lift mechanism for propelling the hammer against the anvil; ix) a dump valve for the mechanism having open and closed cycles; x) a means controlling the rate of the cycles to control the stroke and impact rate of the hammer; and xi) and means for down-crowding the carriage to hold the anvil continuously against the work piece to be driven by the hammer. U.S. Pat. No. 4,869,002 provides an attachment adapted to be mounted to a vehicle for accommodating one of a plurality of tools including a digging bucket, a log splitter, a lifting arm, a post driver or an earth boring auger. The attachment comprises: a) a plurality of horizontal vehicle mounts attached by means of fasteners to the underneath of the front of the vehicle and extending forwardly from the vehicle to form a cradle for receiving a horizontal frame member; b) a horizontal frame member resting in the cradle and held in place by fasteners; c) three sets of swivel devises mounted to the horizontal frame member for receiving a boom swivel or a swing cylinder; d) a boom swivel selectively mounted in any one of the three sets of swivel devises with a swing cylinder mounted in one of the remaining sets; and e) a boom arm having one end pivoted to the boom swivel and adapted to selectively mount one of the plurality of tools. U.S. Pat. No. 4,961,471 sets forth a post hole digger comprising: a) a support base adapted to be mounted on a vehicle for a pivotal movement about a vertical axis; b) a post hole digging auger and motor assembly; c) an elongated support structure pivotally connected at one end to the support base about a horizontal axis. The auger and motor assembly are pivotally connected to the other end of the elongated support structure about a horizontal axis, and the elongated support structure is extendible or retractable to enable positioning of the auger and motor assembly at a desired location and to adjust as the auger and motor assembly lowers and penetrates the ground. The auger and motor assembly are suspended from the elongated support structure so that in a free state the auger and motor assembly is suspended substantially vertically. There is a control handle means present which is adapted to be manually gripped to guide the auger and motor assembly and resist lateral forces occurring during operation of the auger and motor assembly. U.S. Pat. No. 5,746,277 describes an auguring means comprising: a) an extendable mast means having a first mast member and a second mast member, the first mast member having an axis; b) a downcrowding means for extending the second mast member away from the first mast member and for pulling the second mast member towards the first mast member; c) a kelly assembly means having a plurality of telescoping kelly sections which include at least an outer kelly section and an inner kelly section, the outer kelly section having an axis parallel to and spaced apart from the axis of the first mast member; d) a kelly bearing means for rotatably supporting the outer kelly section and for preventing axial displacement of the outer kelly section relative to the kelly bearing means; e) a first support means for supporting the kelly bearing means, and for causing displacement of the outer kelly section along the axis thereof in response to displacement of the second mast member along the axis of, and relative to, the first mast member; f) a kelly rotating means for slidably rotating the outer kelly section about the axis thereof; and g) a second support means for supporting the first mast member and for supporting the kelly rotating means. U.S. Pat. No. 6,155,359 discloses a hole digger system, comprising: a) a spaced apart pair of adjustably extendible support braces, wherein the support braces each have a forwards end; b) an elongate base having a pair of opposite ends, wherein the base is pivotally coupled to the forwards ends of the support braces; c) a telescopic boom arm having a pair of opposite ends and a longitudinal axis extending between the ends of the boom arm, wherein a first of the ends of the boom arm are pivotally coupled to the first of the ends of the base; d) a motor, pivotally coupled to a second of the ends of the boom arm, wherein the motor has a rotating shaft outwardly extending therefrom; e) an elongate auger having opposite mounting and digging ends, wherein the mounting end of the auger are attached to the rotating shaft of the motors. The boom arm has a lowered position wherein the boom arm and the base are extended substantially parallel to one another. The base has a boom rest forwardly extending therefrom, and the boom arm is rested on the boom rest when the boom arm is positioned in the lowered position.

While these devices fulfill their respective, particular objectives and requirements, the aforementioned patents do not disclose a post hole digger that may be fitted to existing vehicles, such as pickup trucks in such a way as to be readily removable from the vehicle for storage, servicing, or placement on another vehicle. In addition, none of the prior art provides a post hole digging apparatus which enables a person owning a pickup truck to add the capability of post hole digging to their vehicle in a matter of seconds. According to the present invention, there is provided such a device, which now means that all which a person needs in order to dig a post hole at any desired location is a pickup truck, a device according to the invention, and a couple minutes of time.

In these respects, the vehicle mounted post hole digger according to the present invention substantially departs from the concepts and designs of the prior art, and provides an apparatus useful for digging post holes in the ground which can be rapidly affixed to any vehicle with a trailer hitch and driven to any desired location to deliver a hole in the ground at a selected location. In addition, a device according to the invention is readily operated by a single person, unlike prior art devices. Thus, two men with two trucks can drastically reduce the amount of time necessary to complete a job task, such as installation of a fence. Finally, the motive energy which a device according to the invention is located on-board of the device, i.e., it has its own source of motive power, as opposed to prior art devices which rely upon PTO's or other motive means.

SUMMARY OF THE INVENTION

The present invention provides a device useful for drilling holes in the earth, and it comprises a horizontal frame member having a first end portion and a second end portion. There is a vertically inclined tubing casing having a first end portion, an open second end portion, a length dimension, and a hollow interior portion, wherein the first end portion of the vertically inclined tubing casing is attached to the second end portion of the horizontal frame member. The vertically inclined tubing casing further comprises a hole disposed through it along its length, the hole having an axis, wherein the axis of the hole is substantially perpendicular to the length dimension of the vertically inclined tubing casing. There is also a vertically inclined brace portion having a first end portion, a second end portion and a length dimension, and the first end portion of the vertically inclined brace is attached to the horizontal frame member at a location between the first end portion of the horizontal frame member and the second end portion of the horizontal frame member, such that the length dimension of the vertically inclined brace portion and the length dimension of the vertically-inclined tubing casing are substantially parallel to one another. There is also an adjustable height support having a first end portion, a second end portion, a length dimension, and a length dimension axis, and the first end portion of the height support and at least a portion of the length of the height support is slidably disposed within the vertically inclined tubing casing. The height support further comprises a plurality of holes disposed through it along its length, and these holes each have an axis, and their axes are substantially perpendicular to the length dimension of the height support. There is a two-axis hinge which is hingedly connected to the second end portion of the height support, and the two-axis hinge has a degree of freedom which enables its rotational movement about the length dimension axis of the height support. There is also a substantially linear vertical guide outer member having a first end portion, an open second end portion, and a length dimension, and the first end portion of the vertical guide outer member is pivotally connected to the height support by means of the two-axis hinge such that the vertical guide outer member is given a sufficient degree of freedom to rotate rendering its second end portion capable of striking out an arc which intersects the adjustable height support at a point along the length of the height support. There is a hydraulic ram having a hydraulic oil inlet, a hydraulic oil outlet, a length dimension, a first end portion disposed at the end of its stationary portion, and a second end portion disposed at the end of its moveable portion, and the hydraulic ram is attached to the vertical guide outer member such that the length dimension of the hydraulic ram and the length dimension of the vertical guide outer member are substantially parallel to one another. There is a substantially linear vertical guide inner member having a first end portion, a second end portion and a length dimension, and at least a portion of the first end portion of the vertical guide inner member is slidably disposed within the vertical guide outer member. The invention further includes a drilling head attached to the second end portion of the hydraulic ram and the second end portion of the vertical guide inner member, and an engine having an output shaft, wherein the engine is mounted to at least one of the horizontal frame member, the vertically inclined tube casing, or the vertically inclined brace portion. There is a hydraulic pump having an input shaft, and the input shaft of the hydraulic pump is in effective mechanical communication with the output shaft of the engine. The invention further includes a hydraulic oil reservoir, and a means for providing hydraulic fluid under pressure from the hydraulic pump to the hydraulic ram.

According to one embodiment, the drilling head comprises: i) a top plate portion; ii) a bottom plate portion having a first hole and a second hole disposed through it; iii) a hydraulic motor having a drive shaft, wherein the hydraulic motor is mounted to the bottom plate portion such that the drive shaft passes through the first hole in the bottom plate portion; iv) a first sprocket disposed on the drive shaft; v) a drilling shaft having a first end portion and a second end portion, the first end portion of the drilling shaft having a second sprocket disposed thereon, the drilling shaft being mounted through the second hole in the bottom plate portion by means of a bearing; vi) a motion communicator, selected from the group consisting of: chains and belts, in contact with each of the first sprocket and the second sprocket; vii) an auger bit having a length dimension, attached to the second end portion of the drilling drive shaft such that the length dimension of the auger bit is substantially parallel to the length dimension of the vertical guide inner member; and viii) means for providing hydraulic fluid under pressure from the hydraulic pump to the hydraulic motor. Preferably, the means for providing hydraulic fluid under pressure from the hydraulic pump to the hydraulic motor comprises a hydraulic conduit disposed between the outlet of said hydraulic pump and the inlet of said hydraulic motor. Preferably, this hydraulic conduit includes a valve means disposed along its length for selectively controlling the flow of hydraulic fluid. In addition, it is preferred that there is a hydraulic conduit for transferring hydraulic oil under low pressure from the outlet of the hydraulic motor to the reservoir.

DETAILED DESCRIPTION

Figure 1:
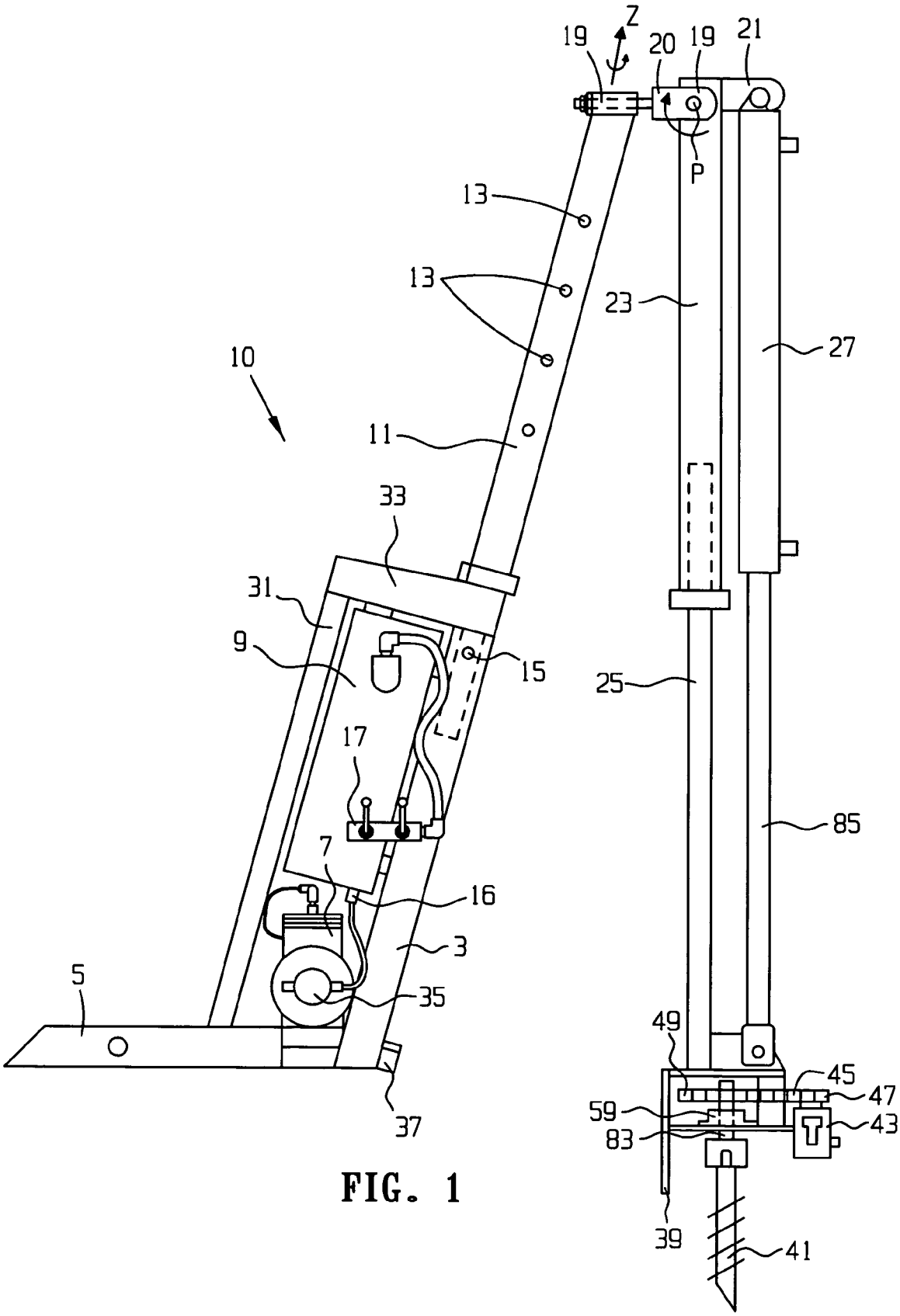
FIG. 1 shows a side perspective view of a device according to a preferred form of the invention in its extended, ready-for-use position.

Referring to the drawings and initially to FIG. 1 there is shown a side perspective view of a quick detach vehicle-mounted auger driver 10 according to a preferred form of the invention. The auger driver 10 includes a horizontal frame member 5, which is preferably comprised of a square tubing construction that is adapted to be inserted into the square hole trailer hitch which is common on motorized vehicles and is adapted to receive square trailer hitches, as is well known in the art. There is a vertically inclined tubing casing 3 which is attached to one of the end portions of the vertically inclined tubing casing such that the vertically inclined tubing casing intersects the horizontal frame member 5 at an angle, which is preferably any angle between about 90 degrees and 45 degrees, with an angle of about 75 degrees being most preferred. The vertically inclined tubing casing includes a hole 15 disposed through its side walls, and preferably comprises a hollow interior portion, which is adapted to receive an adjustable height support 11 in a slidingly telescoping fashion. Thus, the adjustable height support 11 is able to be moved in an out of the vertically inclined tubing casing. The adjustable height support includes a plurality of holes 13 along its sides which are disposed completely through the adjustable height support 11. These holes 13 pass by the hole 15 in the vertically inclined tubing casing as the adjustable height support 11 is moved in or out of the vertically inclined tubing casing 3, thus providing a means by which the adjustable height support 11 may be secured in a fixed position desired by the user of the device with respect to the vertically inclined tubing casing 3 by securing a pin through the hole 15 when the hole of the vertically inclined tubing casing is aligned with one of the holes in the adjustable height support.

There is a vertically inclined brace 31 which has two end portions, wherein one of its end portions is attached to the horizontal frame member 5 at a location between the two end portions of the horizontal frame member. The other end portion of the vertically inclined brace 31 is attached to a brace plate 33 which itself is also attached to the vertically inclined tubing casing 3, to provide strength of the construction as a whole.

An oil reservoir 9 is attached to any of the basic frame members of a device according to the invention, the vertically inclined brace portion 31, the brace plate 33, or the vertically inclined tubing casing 3, such as by welding. In fact, it is preferred that all of the structural members and other components of a device according to the invention are comprised of steel or any other metal known in the art, and all attachments are made by welding. However, the use of conventional fasteners is also useful, as one of ordinary skill will recognize after reading this specification and the appended claims. To aid the person in the art constructing a device according to the invention, brackets may be used, when deemed desirable or convenient for attaching the various components of the invention to one another, as the use of brackets are well-known in the art. The oil reservoir 9 is preferably attached to the vertically inclined tubing casing 3, by welding. The purpose of the oil reservoir 9 is to contain the hydraulic fluid which is used to convey the forces required for the instant invention to be operated.

There is also an engine 7 which is responsible for providing all of the energy which drives the device 10 according to the invention, rendering it capable of being deemed as a self-powered device, unlike the devices of the prior art which rely in general on power supplied by the vehicle to which they are attached. The engine 7 may be a gasoline engine (either 2 cycle or 4-cycle), a diesel engine, or an electric engine, but is most preferably a gasoline engine having a horsepower rating of about 5 horsepower. The engine 7 is preferably attached to the device by welding either to the horizontal frame member 5 or the vertically inclined tubing casing 3. In an alternate embodiment, the engine is attached to two angle iron brackets which are welded perpendicular to the frame member 5, and the engine is bolted to these angle brackets. There is a hydraulic pump 35, which is in effective mechanical contact with the output shaft of the engine 7 so as to provide hydraulic oil under pressure, which is used to operate the hydraulic ram and hydraulic motor, as elsewhere described herein, through the use of hydraulic valves 17, which are used to selectively operate a fluid powered component device of the invention.

As described above, the adjustable height support 11 has two end portions, with one of its end portions being disposed in the interior of the vertically inclined tubing casing 3. The other end portion of the adjustable height support is equipped with a two-axis hinge 19. The two-axis hinge 19 is attached to the outer surface of the adjustable height support 11 in such fashion as to enable rotation of the entire two-axis hinge as a whole about the adjustable height support 11 in the direction indicated by the arrow surrounding the z-axis in FIG. 1. The two-axis hinge 19 also includes a yoke sub element 20, which is pivotally connected to one of the end portions of a vertical guide outer member 23 by means of a pin P which pin P is disposed through both forks of the yoke 20 and through the vertical guide outer member 23, so as to enable the vertical guide outer member 23 to move in a swinging motion whose general direction is indicated by the arrow in FIG. 1 which is disposed about the pin P. The vertical guide outer member 23 is of hollow tubular construction, and its end portion which is not connected to the two-axis hinge 19 is an open end, which is adapted to receive a first end portion of vertical guide inner member 25 in a sliding arrangement. The other (second) end of the vertical guide inner member 25 is attached to the drilling head, which is described in greater detail below.

Also attached to the two-axis hinge 19 by means of a bracket 21 is the end portion of the stationary section 27 of a hydraulic ram, which hydraulic ram hangs vertically and in substantial parallel orientation with respect to the vertical guide outer member 23 and vertical guide inner member 25 when the device 10 of the invention is in use. The hydraulic ram has a moveable portion 85 whose free end is attached to the drilling head, which is also described in greater detail below.

The drilling head includes a hydraulic motor 43, which is powered by hydraulic fluid caused to be under pressure from the operation of the engine 7. The hydraulic motor 43 includes a first sprocket disposed on its output shaft, which is coupled to a second sprocket 49 that is disposed on the end of a boring drive shaft 83 by means of a motive communicator, which is preferably a drive chain 45. The boring drive shaft is mounted by means of a bearing 59. The drilling head also preferably comprises a tang 39, which is adapted to be received by a loop of metal 37 disposed on the vertically inclined tubing casing 3 during storage and transportation of a device according to the invention, so as to preclude rotation of the vertical guide outer member 23 and hydraulic ram about the z-axis during transportation and/or storage.

While the components of the invention which are cooperatively connected in a sliding arrangement (the vertically inclined tubing casing 3, the adjustable height support 11, the vertical guide outer member 23 and the vertical guide inner member 25) are preferably comprised of tubing which is square-shaped in cross section, any cross sectional geometry which accomplishes this same result is functionally equivalent for purposes of the present invention, including without limitation, round tubings, oval tubings, triangular tubings, etc. The main requisite of the materials of construction chosen from which to fabricate these elements is structural strength, as the device as a whole is subjected to significant stresses during the boring of a hole in the earth, and for this reason it is preferred that these elements be comprised of steel tubing. In addition, steel tubing lends itself well to attachment by welding.

Figure 2:
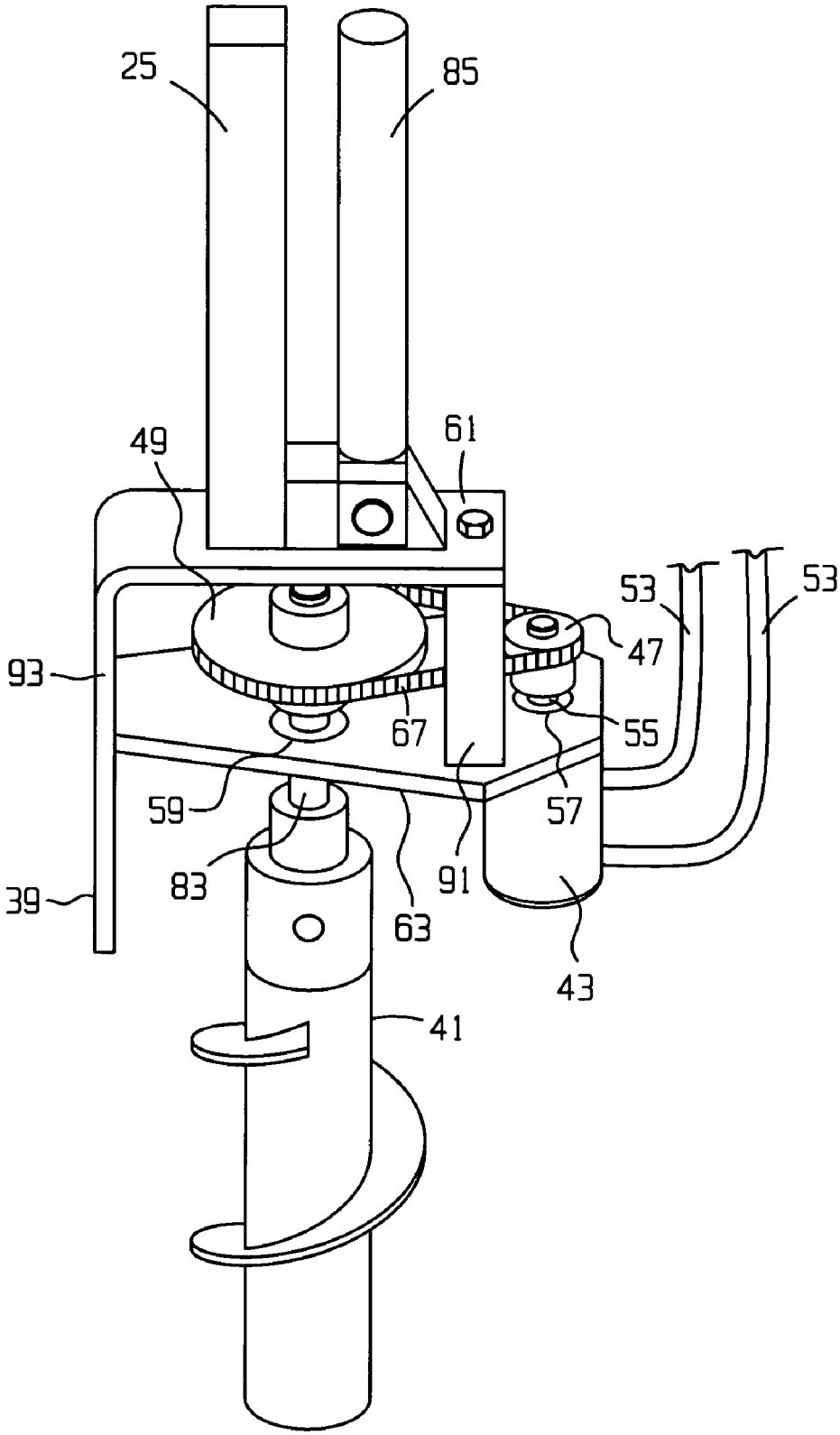
FIG. 2 shows a perspective view of the drilling head portion of a device according to a preferred form of the invention.

FIG. 2 shows the drilling head used in accordance with a preferred form of the invention. In this figure, it can be seen that the drilling head includes a top plate portion 61, to which the ends of the vertical guide outer member 25 and moveable portion 85 of the hydraulic ram are attached. There is also a bottom plate portion 63, which is attached to the top plate 61 by means of brackets 91 and 93, which are either welded or bolted to one another. The bottom plate portion 63 includes hydraulic motor 43 attached to the bottom plate and having its drive shaft pass through a hole in the bottom plate by means of a bearing 57. Fluid under pressure is supplied to the hydraulic motor by means of hydraulic lines 53. The drive shaft 55 of the hydraulic motor 43 has a first sprocket disposed on its end portion. There is also a boring drive shaft 83 mounted through another hole in the bottom plate portion 63 by means of a bearing 59, and at one end of the boring drive shaft is disposed a second sprocket 49. The first sprocket are caused to be in effective mechanical contact with one another by means of a motion communicator 67, which is preferably a drive chain (45 in FIG. 1). The other end of the boring drive shaft 83 is connected to an auger, which is rotated with sufficient motive energy to drill a hole in the ground by virtue of energy conveyed to the drive shaft from the hydraulic motor 43 by the motion communicator 67. The drilling head preferably includes a tang portion 39, which is rectangular in its frontal view in one preferred form of the invention, and is thus well adapted to be received by the tang slot 37 on the vertically inclined tubing casing 3 when the device 10 is being stored or transported as is more clearly shown in FIG. 3.

Figure 3:
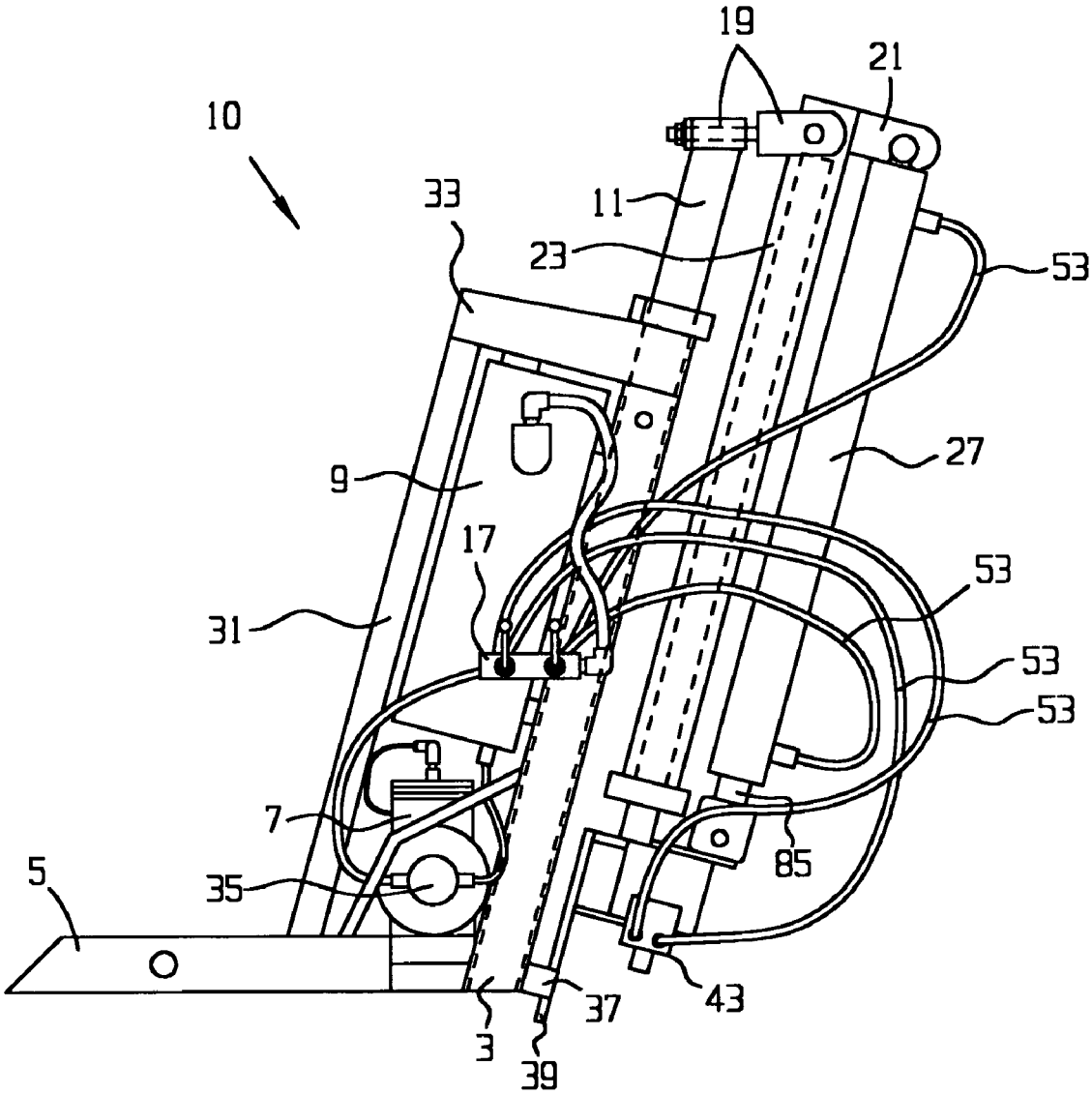
FIG. 3 shows a side perspective view of a device according to a preferred form of the invention when in its collapsed configuration, ready for transportation or storage.

FIG. 3 shows a device 10 according to the invention in its collapsed form, such as while being transported or stored. In this configuration, the vertical guide inner member 25 is seen to be recessed in the vertical guide outer member 23, and the hydraulic ram moveable portion 85 is recessed within the hydraulic ram stationary portion 27, which compacts the device 10 considerably as opposed to when the device is in hole-drilling mode. The tang portion 39 is disposed within the tang slot 37, which prevents the vertical guide outer member 23 and hydraulic ram from rotating about the z-axis (FIG. 1) and swinging from side to side during movement of the truck 100 (FIG. 4) to which such a device 10 is attached, such as between job locations. In this FIG. 3 are shown the various elements of a device according to the invention in their respective positions, including the horizontal frame member 5, vertically inclined tubing casing 3, hydraulic pump 35, engine 7, vertically inclined brace 31, brace plate 33, hydraulic oil tank 9, hydraulic valves 17, adjustable height support 11, two-axis hinge 19, vertical guide outer member 23, brace 21, hydraulic ram stationary portion 27, hydraulic lines 53, and hydraulic motor 43.

Figure 4:
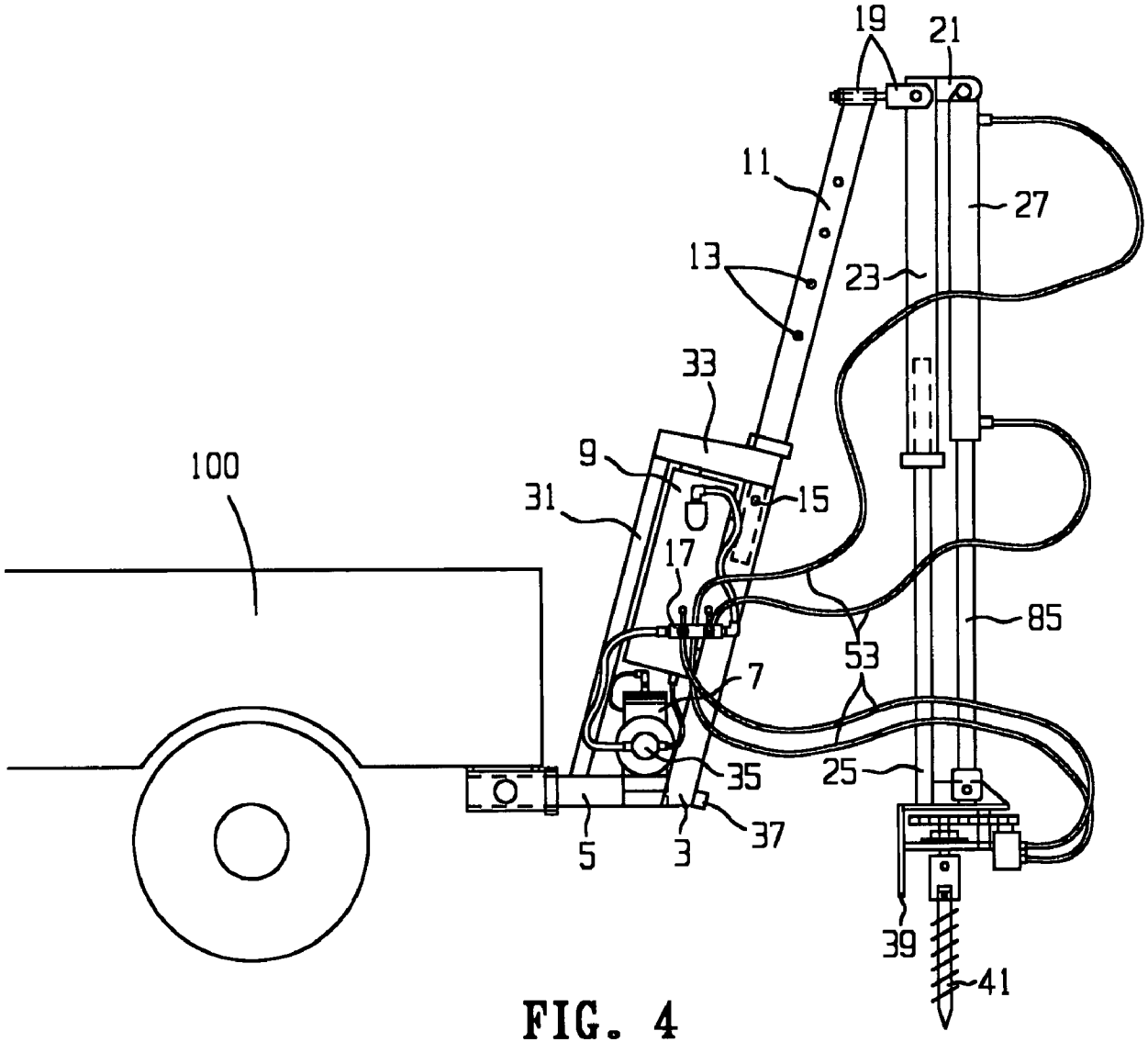
FIG. 4 shows a side perspective view of a device according to a preferred form of the invention, in its extended, ready-for-use position, including hydraulic lines and attached to a pickup truck.

FIG. 4 shows a side view of a device according to the invention in its normal configuration when being used to drill a hole in the ground, including the hydraulic lines which were omitted from FIG. 1 for purposes of clarity. In this FIG. 4 are shown the various elements of a device according to the invention in their respective positions, including the horizontal frame member 5, vertically inclined tubing casing 3, hydraulic pump 35, engine 7, vertically inclined brace 31, brace plate 33, hydraulic oil tank 9, hydraulic valves 17, adjustable height support 11, holes 13, hole 15, two-axis hinge 19, vertical guide outer member 23, vertical guide inner member 25, brace 21, hydraulic ram stationary portion 27, hydraulic ram moveable portion 85, hydraulic lines 53, hydraulic motor 43, auger 41, and motorized vehicle 100, which is a pickup truck.

As previously described, a device according to the invention includes two devices which are powered by hydraulic fluid under pressure, which are the hydraulic motor 43 and the hydraulic ram, having a stationary portion 27 and a moveable portion 85 as its sub-components, as is well known in the art. Each of these devices which are powered by hydraulic fluid have a fluid inlet portion and a fluid outlet portion. Each of the fluid inlet portions of these fluid operated devices are in effective fluid contact with the high pressure side of the hydraulic pump 35 through means of the various hydraulic lines 53, which high pressure lines have a control valve disposed between the hydraulic pump high pressure side and the fluid inlet on the fluid-driven devices, to enable selective control of these devices by the operator. The fluid outlets of each of the fluid-driven devices are routed back to the oil reservoir 9, whose bottom portion is fitted with an outlet (16 in FIG. 1) from which the hydraulic pump 35 is fed.

To use a device according to the present invention which is attached to a pickup truck and in its collapsed position as shown in FIG. 3, the operator starts the engine 7, and pulls the pin out from the hole 15, thus freeing the adjustable height support 11 to move within the vertically inclined tubing casing. Fluid under pressure is caused to enter the hydraulic ram, thus pushing the stationary portion 27 of the hydraulic ram, the vertical guide outer member 23, and the adjustable height support 11 upwards, since the tang 39 is engaged in the tang slot 37. Thus it is seen that the tang 39 and tang slot 37 serve a dual purpose of keeping the assembly as a whole stable during storage and transportation, and also as an anchor for the drilling head to be held stationary whilst the above-mentioned components are caused to move upwards at the onset of the procedure for using a device 10 according to the invention. Once the stationary portion 27 of the hydraulic ram, the vertical guide outer member 23, and the adjustable height support 11 have been moved upwards sufficiently to place them in their desired position for operation of the device, the pin is placed back in the hole 15 to render the adjustable height support 11 to once again be in rigid contact with the vertically inclined tubing casing 3. Next, the flow of hydraulic fluid to the hydraulic ram is reversed, which causes the tang 39 of the drilling head to be lifted out of the tang slot 37, thus freeing the drilling head from its former stored position abutting the vertically inclined tubing casing 3. Under the influence of gravity, the drilling head then swings out into the position shown in FIG. 1 and FIG. 4. Next, the drill auger 41 is installed on the boring drive shaft 83 and pressure is applied to the hydraulic ram to cause the auger 41 to contact the earth, and the hydraulic motor 43 is activated, thus causing a hole to be drilled in the ground by virtue of a constant downward force applied by the hydraulic ram and the spiraling motion of the auger 41. Once the desired depth of hole has been achieved, the auger 41 is retracted by actuation of the hydraulic ram, and the pickup truck to which the device is attached is driven to the site of the next desired hole.

On shutdown, the drilling auger 41 is removed, and the drilling head is swung until the tang 39 is disposed above the tang slot 37, at which time the ram is actuated sufficiently to enable the tang to completely enter the slot. Then the pin is removed from the hole 15 and the adjustable height support 11 is returned to its stowed position as shown in FIG. 3, and the pin replaced into hole 15.

Consideration must be given to the fact that although this invention has been described and disclosed in relation to certain preferred embodiments, obvious equivalent modifications and alterations thereof will become apparent to one of ordinary skill in this art upon reading and understanding this specification and the claims appended hereto. Accordingly, the presently disclosed invention is intended to cover all such modifications and alterations, and is limited only by the scope of the claims that follow.

I claim:

1. A device useful for drilling holes in the earth comprising:

a) a horizontal frame member having a first end portion and a second end portion;

b) a vertically inclined tubing casing having a first end portion, an open second end portion, a length dimension, and a hollow interior portion, wherein said first end portion of said vertically inclined tubing casing is attached to the second end portion of said horizontal frame member, said vertically inclined tubing casing further comprising a hole disposed through it along its length, said hole having an axis, wherein the axis of said hole is substantially perpendicular to the length dimension of said vertically inclined tubing casing;

c) a vertically inclined brace portion having a first end portion, a second end portion and a length dimension, wherein said first end portion of said vertically inclined brace is attached to said horizontal frame member at a location between said first end portion of said horizontal frame member and said second end portion of said horizontal frame member, such that the length dimension of said vertically inclined brace portion and the length dimension of said vertically-inclined tubing casing are substantially parallel to one another;

d) an adjustable height support having a first end portion, a second end portion, a length dimension, and a length dimension axis, wherein said first end portion of said height support and at least a portion of the length of said height support is slidably disposed within said vertically inclined tubing casing, said height support further comprising a plurality of holes disposed through it along its length, said holes each having an axis, wherein the axis of said holes are substantially perpendicular to the length dimension of said height support;

e) a two-axis hinge which is hingedly connected to said second end portion of said height support, said two-axis hinge having a degree of freedom which enables its rotational movement about said length dimension axis of said height support;

f) a substantially linear vertical guide outer member having a first end portion, an open second end portion, and a length dimension, wherein said first end portion of said vertical guide outer member is pivotally connected to said height support by means of said two-axis hinge such that said vertical guide outer member is given a sufficient degree of freedom to rotate rendering its second end portion capable of striking out an arc which intersects said adjustable height support at a point along the length of said height support;

g) a hydraulic ram having a hydraulic oil inlet, a hydraulic oil outlet, a length dimension, a first end portion disposed at the end of its stationary portion, and a second end portion disposed at the end of its moveable portion, wherein said hydraulic ram is attached to said vertical guide outer member such that said length dimension of said hydraulic ram and the length dimension of said vertical guide outer member are substantially parallel to one another;

h) a substantially linear vertical guide inner member having a first end portion, a second end portion and a length dimension, wherein at least a portion of said first end portion of said vertical guide inner member is slidably disposed within said vertical guide outer member i) a drilling head attached to said second end portion of said hydraulic ram and said second end portion of said vertical guide inner member;

j) an engine, wherein said engine is mounted to at least one of said horizontal frame member, said vertically inclined tube casing, or said vertically inclined brace portion;

k) a hydraulic pump in effective mechanical contact with said engine such that said engine supplies motive power to said pump;

l) a hydraulic oil reservoir; and m) means for providing hydraulic fluid under pressure from said hydraulic pump to said hydraulic ram.

2. A device according to claim 1 wherein said engine is an engine selected from the group consisting of: gasoline engines, diesel engines, and electric engines.

3. A device according to claim 1 wherein said means for providing hydraulic fluid under pressure from said hydraulic pump to said hydraulic ram comprises a first hydraulic conduit disposed between the outlet of said hydraulic pump and the inlet of said hydraulic ram.

4. A device according to claim 3 wherein said first hydraulic conduit includes a valve means disposed along its length for selectively controlling the flow of hydraulic fluid.

5. A device according to claim 4 further comprising a second hydraulic conduit for transferring hydraulic oil under low pressure from the outlet of said hydraulic ram to said reservoir.

6. A device according to claim 4 further comprising a fourth hydraulic conduit for transferring hydraulic oil under low pressure from the outlet of said hydraulic motor to said reservoir.

7. A device according to claim 1 wherein said drilling head comprises:

i) a top plate portion;

ii) a bottom plate portion having a first hole and a second hole disposed therethrough;

iii) a hydraulic motor having a drive shaft, wherein said hydraulic motor is mounted to said bottom plate portion such that said drive shaft passes through said first hole in said bottom plate portion;

iv) a first sprocket disposed on said drive shaft;

v) a drilling shaft having a first end portion and a second end portion, said first end portion of said drilling shaft having a second sprocket disposed thereon, said drilling shaft being mounted through said second hole in said bottom plate portion by means of a bearing;

vi) a motion communicator, selected from the group consisting of: chains and belts, in contact with each of said first sprocket and said second sprocket;

vii) an auger bit having a length dimension, attached to said second end portion of said drilling drive shaft such that the length dimension of said auger bit is substantially parallel to the length dimension of said vertical guide inner member; and viii) means for providing hydraulic fluid under pressure from said hydraulic pump to said hydraulic motor.

8. A device according to claim 7 wherein said means for providing hydraulic fluid under pressure from said hydraulic pump to said hydraulic motor comprises a third hydraulic conduit disposed between the outlet of said hydraulic pump and the inlet of said hydraulic motor.

9. A device according to claim 8 wherein said third hydraulic conduit includes a valve means disposed along its length for selectively controlling the flow of hydraulic fluid.

10. A device according to claim 1 wherein said vertically inclined tubing casing intersects the horizontal frame member at an angle which is any angle between about 90 degrees and 45 degrees.

11. A device according to claim 1 wherein said vertically inclined tubing casing intersects the horizontal frame member at an angle of about 75 degrees.

12. A device according to claim 1 wherein said first end portion of the horizontal frame member is adapted to be inserted into a trailer hitch on a motorized vehicle.

13. A motorized vehicle having a trailer hitch and further comprising a device comprising:

a) a horizontal frame member having a first end portion and a second end portion;

b) a vertically inclined tubing casing having a first end portion, an open second end portion, a length dimension, and a hollow interior portion, wherein said first end portion of said vertically inclined tubing casing is attached to the second end portion of said horizontal frame member, said vertically inclined tubing casing further comprising a hole disposed through it along its length, said hole having an axis, wherein the axis of said hole is substantially perpendicular to the length dimension of said vertically inclined tubing casing:

c) a vertically inclined brace portion having a first end portion, a second end portion and a length dimension, wherein said first end portion of said vertically inclined brace is attached to said horizontal frame member at a location between said first end portion of said horizontal frame member and said second end portion of said horizontal frame member, such that the length dimension of said vertically inclined brace portion and the length dimension of said vertically-inclined tubing casing are substantially parallel to one another;

d) an adjustable height support having a first end portion, a second end portion, a length dimension, and a length dimension axis, wherein said first end portion of said height support and at least a portion of the length of said height support is slidably disposed within said vertically inclined tubing casing, said height support further comprising a plurality of holes disposed through it along its length, said holes each having an axis, wherein the axis of said holes are substantially perpendicular to the length dimension of said height support;

e) a two-axis hinge which is hingedly connected to said second end portion of said height support, said two-axis hinge having a degree of freedom which enables its rotational movement about said length dimension axis of said height support;

f) a substantially linear vertical guide outer member having a first end portion, an open second end portion, and a length dimension, wherein said first end portion of said vertical guide outer member is pivotally connected to said height support by means of said two-axis hinge such that said vertical guide outer member is given a sufficient degree of freedom to rotate rendering its second end portion capable of striking out an arc which intersects said adjustable height support at a point along the length of said height support;

g) a hydraulic ram having a hydraulic oil inlet, a hydraulic oil outlet, a length dimension, a first end portion disposed at the end of its stationary portion, and a second end portion disposed at the end of its moveable portion, wherein said hydraulic ram is attached to said vertical guide outer member such that said length dimension of said hydraulic ram and the length dimension of said vertical guide outer member are substantially parallel to one another;

h) a substantially linear vertical guide inner member having a first end portion, a second end portion and a length dimension, wherein at least a portion of said first end portion of said vertical guide inner member is slidably disposed within said vertical guide outer member i) a drilling head attached to said second end portion of said hydraulic ram and said second end portion of said vertical guide inner member;

j) an engine, wherein said engine is mounted to at least one of said horizontal frame member, said vertically inclined tube casing, or said vertically inclined brace portion;

k) a hydraulic pump in effective mechanical contact with said engine such that said engine supplies motive power to said pump;

l) a hydraulic oil reservoir; and m) means for providing hydraulic fluid under pressure from said hydraulic pump to said hydraulic ram affixed to said trailer hitch by virtue of said first end portion of said horizontal frame member being inserted into said trailer hitch.

* * * * *